US009809964B1

(12) United States Patent
Williams

(10) Patent No.: US 9,809,964 B1
(45) Date of Patent: Nov. 7, 2017

(54) URINE SHIELD FOR A TOILET

(71) Applicant: Edward Williams, Doraville, GA (US)

(72) Inventor: Edward Williams, Doraville, GA (US)

( * ) Notice: Subject to any disclaimer, the term of this patent is extended or adjusted under 35 U.S.C. 154(b) by 0 days.

(21) Appl. No.: 15/341,035

(22) Filed: Nov. 2, 2016

(51) Int. Cl.
*E03D 9/00* (2006.01)
*A47K 13/24* (2006.01)

(52) U.S. Cl.
CPC ..... *E03D 9/00* (2013.01); *A47K 13/24* (2013.01); *E03D 9/002* (2013.01)

(58) Field of Classification Search
CPC ..... E03D 9/00
USPC ..... 4/300.3
See application file for complete search history.

(56) References Cited

U.S. PATENT DOCUMENTS 2,767,408 A * 10/1956 Reibman ..... A47K 13/06 297/452.11
2,980,919 A * 4/1961 Otto ..... A47K 13/24 4/300.3
3,071,778 A * 1/1963 Renshaw ..... A47K 13/24 4/300.3
3,193,845 A * 7/1965 Funk ..... A47K 13/14 4/300.3
3,914,803 A * 10/1975 Gregovski ..... A47K 13/24 4/300.3
4,060,859 A * 12/1977 Anderson ..... E03D 9/00 4/300
4,133,062 A * 1/1979 Fulbright, Jr. ..... A47K 13/10 4/246.1
4,348,776 A * 9/1982 Sarjeant ..... A47K 13/08 4/300.3
5,276,925 A * 1/1994 Blaha ..... E03D 11/025 4/300.3
5,373,589 A * 12/1994 Rego ..... E03D 9/00 4/300.3
5,564,135 A * 10/1996 Jones ..... E03D 9/00 4/300.3
D394,497 S * 5/1998 Johnson ..... E03D 9/00 D23/310
D394,900 S * 6/1998 Kang ..... E03D 9/00 D23/307
5,815,851 A * 10/1998 Perry ..... A47K 13/24 4/300.3
6,032,302 A * 3/2000 Eckert ..... A47K 13/24 4/300.3
6,357,055 B1 * 3/2002 Gambla ..... A47K 17/00 4/300.3

(Continued)

FOREIGN PATENT DOCUMENTS

WO 2012011870 1/2012

*Primary Examiner* — Lori Baker
(74) *Attorney, Agent, or Firm* — Kyle A. Fletcher, Esq.

(57) ABSTRACT

The urine shield for a toilet is a collapsible splatter guard that is adapted for use with a toilet. The urine shield for a toilet attaches to the toilet between the toilet rim and the toilet seat. When extended, the urine shield for a toilet extends the enclosed space formed by the toilet bowl by creating a first U shaped structure. The purpose of the urine shield for toilet is to contain the random sprays and splashes of urination. The urine shield for a toilet retracts into a pair of housings that is attached to the toilet rim and mounted within the toilet bowl perimeter. The pair of housings contains a cleaning fluid that cleanses the first U shaped structure when the urine shield for a toilet is not in use. The urine shield for a toilet comprises a shield and a pair of housings.

18 Claims, 6 Drawing Sheets

(56) References Cited

U.S. PATENT DOCUMENTS 6,385,785 B1 * 5/2002 Linden ..... A47K 13/24 4/300.3
D458,669 S * 6/2002 Sanders ..... E03D 9/00 D23/307
6,550,075 B1 * 4/2003 Brannon, III ..... A47K 13/24 4/300.3
6,874,171 B2 * 4/2005 Erves ..... E03D 9/00 4/300.3
7,043,773 B2 * 5/2006 McAleenan, Jr. ..... A47K 13/24 4/144.1
D523,127 S * 6/2006 Sublett ..... E03D 9/00 D23/310
7,178,177 B1 * 2/2007 Valencia ..... E03D 9/00 4/300.3
D540,449 S * 4/2007 Stevenson ..... E03D 9/00 D23/310
7,373,673 B1 * 5/2008 Holland ..... A47K 13/24 4/661
D571,902 S * 6/2008 Carson ..... E03D 9/00 D23/309
7,921,478 B1 * 4/2011 Vanini ..... E03D 9/00 4/144.1
D655,132 S * 3/2012 Chowning ..... E03D 9/00 D7/387
8,393,022 B2 * 3/2013 Dachowski ..... A61C 17/14 4/263
8,856,976 B1 * 10/2014 Niedzielski, III ..... E03D 9/00 4/300.3
8,984,674 B1 * 3/2015 Harris ..... A61F 5/451 4/144.1
D731,040 S * 6/2015 Danowski ..... E03D 9/00 D23/302
9,139,995 B2 * 9/2015 Escudero ..... E03D 9/00
D787,031 S * 5/2017 Morgan-Williams ..... E03D 9/00 D23/307
2002/0038475 A1 * 4/2002 Garrett ..... A47K 13/24 4/300.3
2004/0237181 A1 * 12/2004 Atkins-Williams ... A47K 13/24 4/300.3
2005/0055757 A1 * 3/2005 Boals ..... E03D 9/00 4/300.3
2005/0193482 A1 * 9/2005 Gambla ..... E03D 9/00 4/300.3
2005/0198727 A1 * 9/2005 Conn ..... E03D 13/005 4/300.3
2006/0041998 A1 * 3/2006 Lattanzi ..... E03D 9/00 4/300.3
2007/0089225 A1 * 4/2007 Wolf ..... A47K 13/06 4/300.3
2014/0310865 A1 * 10/2014 Lin ..... A47K 13/24 4/300.3
2015/0040303 A1 * 2/2015 Uhm ..... E03D 9/00 4/300.3

* cited by examiner

URINE SHIELD FOR A TOILET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessories for water closets with flushing devices, more specifically, urine splash shield.

SUMMARY OF INVENTION

The urine shield for a toilet is a collapsible splatter guard that is adapted for use with a toilet. The toilet is further defined with a seat, a rim, and a bowl. The urine shield for a toilet attaches to the toilet between the toilet rim and the toilet seat. When extended, the urine shield for a toilet extends the enclosed space formed by the toilet bowl by creating a first U shaped structure that rises through the toilet aperture above the toilet rim. The purpose of the urine shield for toilet is to contain the sprays and splashes of urination resulting from the random nature of turbulent fluid flow. The urine shield for a toilet retracts into a pair of housings that is attached to the toilet rim and mounted within the toilet bowl perimeter. The pair of housings contains a cleaning fluid that cleanses the first U shaped structure when the urine shield for a toilet is not in use.

These together with additional objects, features and advantages of the urine shield for a toilet will be readily apparent to those of ordinary skill in the art upon reading the following detailed description of the presently preferred, but nonetheless illustrative, embodiments when taken in conjunction with the accompanying drawings.

In this respect, before explaining the current embodiments of the urine shield for a toilet in detail, it is to be understood that the urine shield for a toilet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the urine shield for a toilet.

It is therefore important that the claims be regarded as including such equivalent construction insofar as they do not depart from the spirit and scope of the urine shield for a toilet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
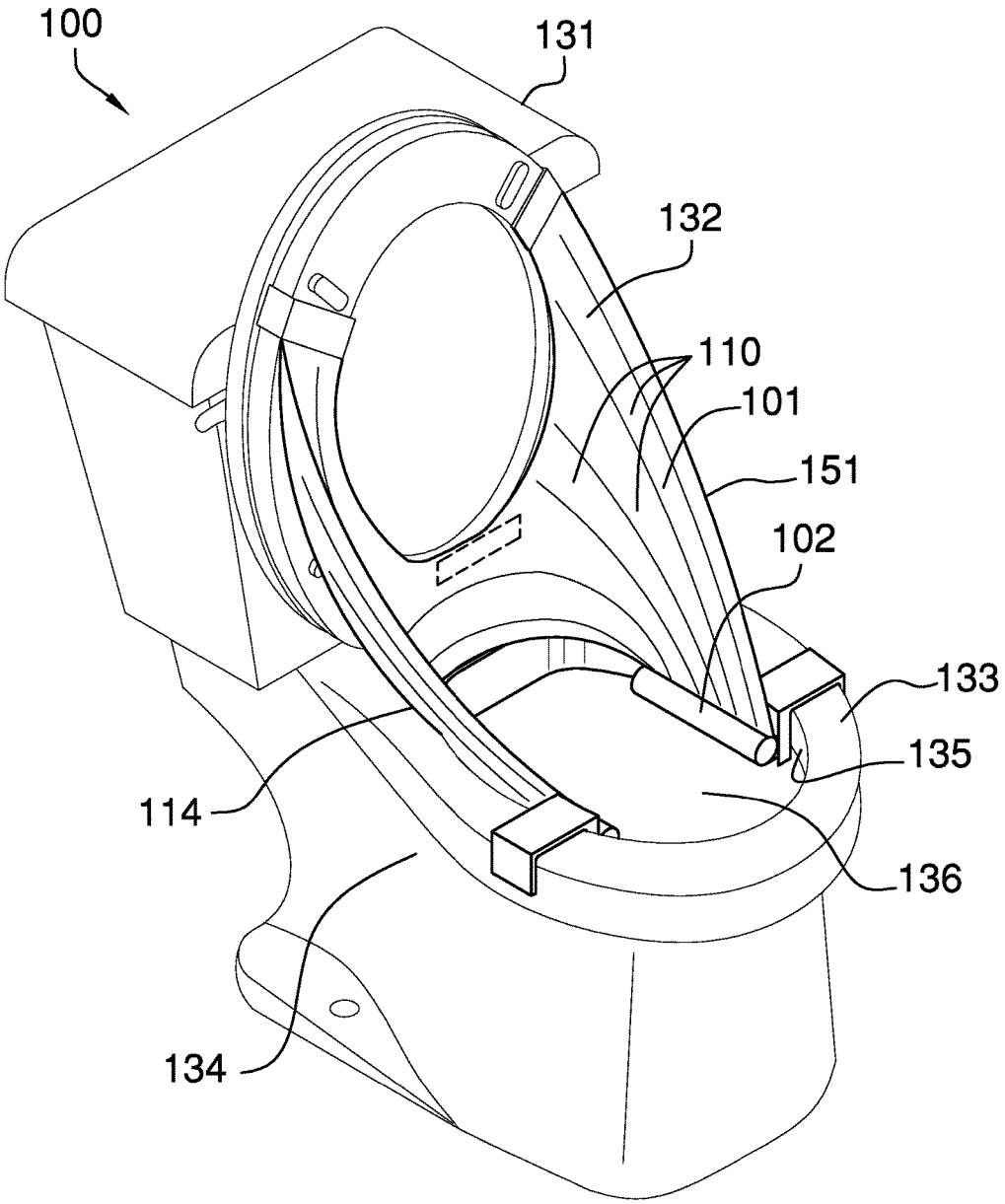
FIG. 1 is a perspective view of an extended embodiment of the disclosure.
Figure 2:
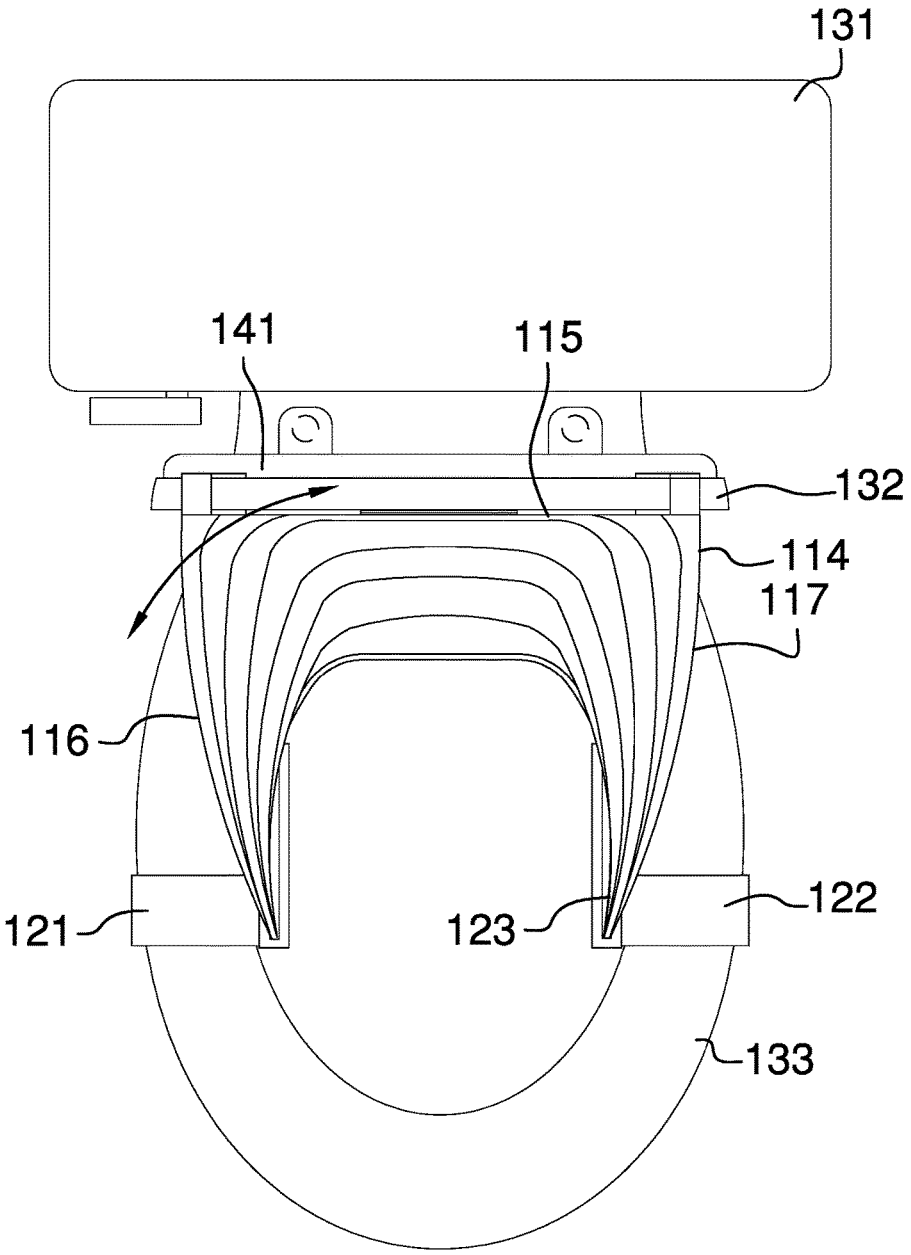
FIG. 2 is a top view of an embodiment of the disclosure.
Figure 3:
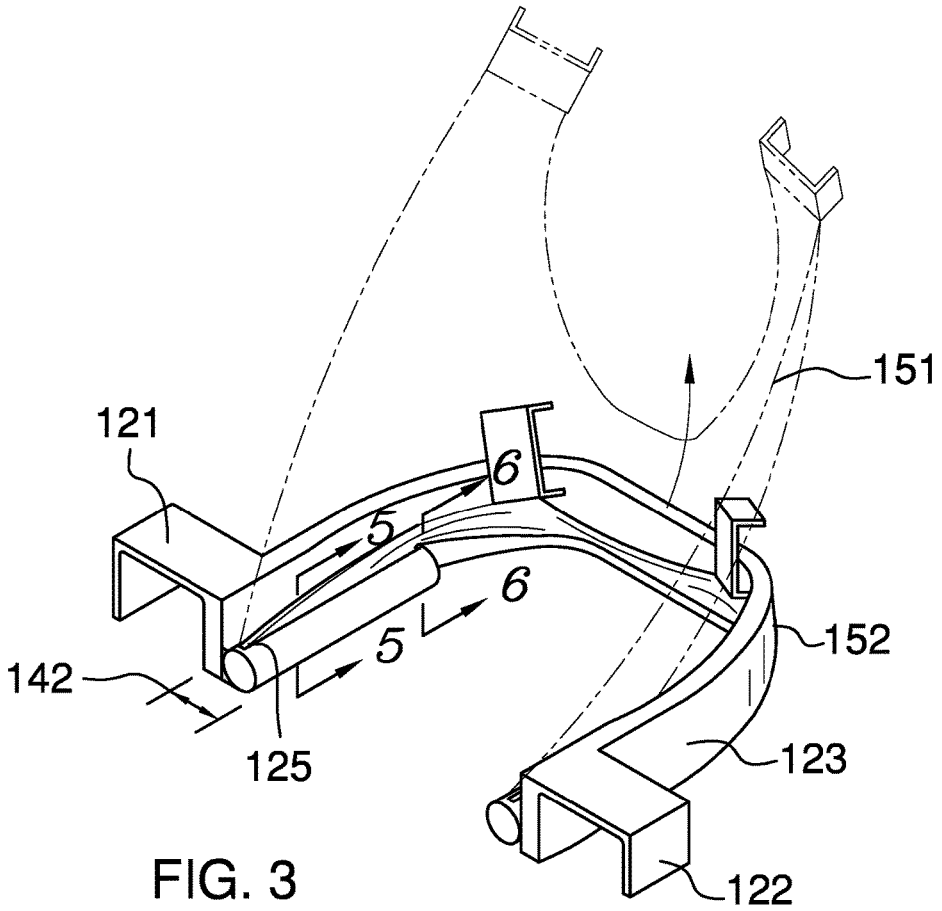
FIG. 3 is a perspective view of a retracted embodiment of the disclosure.
Figure 4:
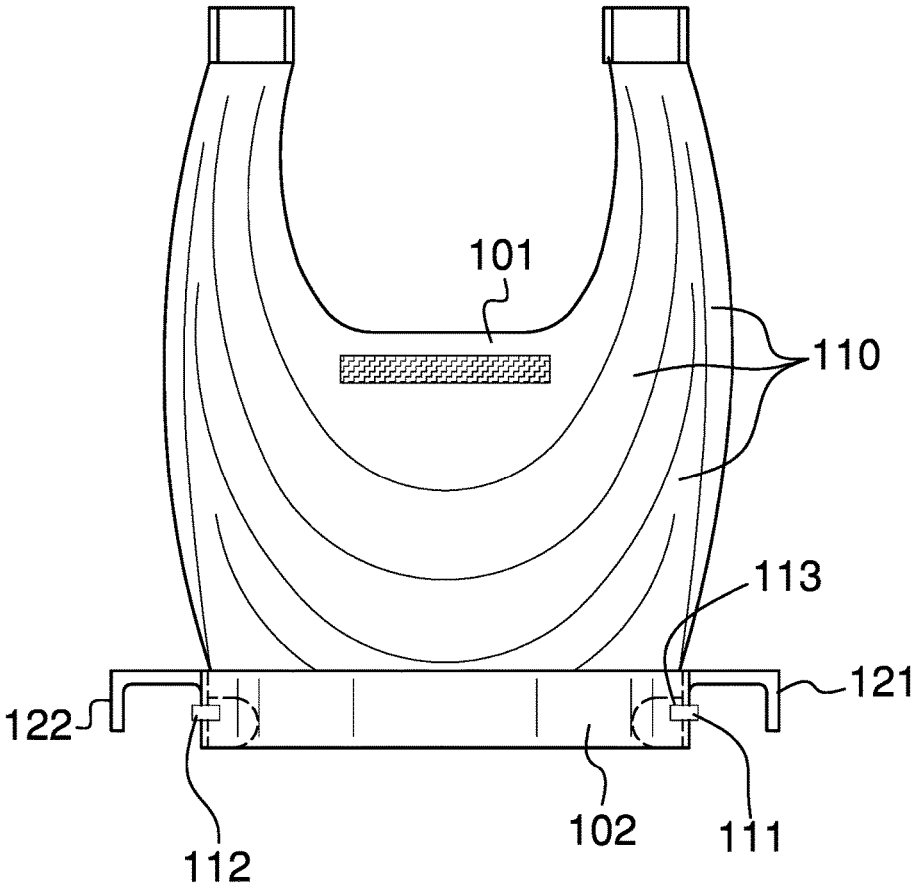
FIG. 4 is a back view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The urine shield for a toilet 100 (hereinafter invention) comprises a shield 101 and a pair of housings 102. The shield 101 is partially stored within the pair of housings 102. The shield 101 extends 151 beyond the pair of housings 102 when the invention 100 is in use to form a first U shaped structure 114 that forms a protective shell. The invention 100 is a collapsible splatter guard that is adapted for use with a toilet 131.

The toilet 131 is further defined with a seat 132, a rim 133, a bowl 134, a perimeter 135, and an aperture 136. The aperture 136 is the opening of the toilet 131 bowl 134 through which waste is deposited. The toilet 131 bowl 134 perimeter 135 is the interior surface of the toilet 131 bowl 134 adjacent to the toilet 131 rim 133. The invention 100 attaches to the toilet 131 between the toilet 131 rim 133 and the toilet 131 seat 132. When extended 151, the invention 100 extends 151 the enclosed space formed by the toilet 131 bowl 134 by creating a first U shaped structure 114 from the shield 101 in a manner that rises through the toilet 131 aperture 136 above the toilet 131 rim 133. The purpose of the invention 100 is to contain the sprays and splashes of urination resulting from the random nature of turbulent fluid flow. The invention 100 retracts 152 into the pair of housings 102 that is attached to the toilet 131 rim 133 and mounted within the toilet 131 bowl 134 perimeter 135. Each of the pair of housings 102 contains a cleaning fluid 124 that cleanses a portion of the first U shaped structure 114 that retracts into the pair of housings 101 when the invention 100 is not in use.

The invention 100 includes a first pivot 111, a second pivot 112, and a lock 113. The first pivot 111, the second pivot 112, and the lock 113 attach the shield 101 to the pair of housings 102. The shield 101 may be further defined with a plurality of shield segments 110. Each of the plurality of shield segments 110 partially overlaps an adjacent one of the plurality of shield segments 110. The plurality of shield segments 110 is arranged relative to each other in order to form the first U shaped structure 114.

Each of the plurality of shield segments 110 selected from the shield 101 is a rigid structure that comprises a wing 115, a first arm 116, and a second arm 117. As shown most clearly in FIG. 2, the first arm 116 and the second arm 117 are attached to the wing 115 such that the edge of the wing 115 that the second arm 117 is attached to is distal from the edge of the wing 115 that the first arm 116 is attached. The surfaces of the wing 115, the first arm 116, and the second arm 117 are formed with a first curvature 141 such that outer contour of each of the plurality of shield segments 110 will follow the contour of the toilet 131 bowl 134 perimeter 135. The first arm 116 has a trapezoidal shape with rounded corners at the edge that is distal from the wing 115. The second arm 117 has a trapezoidal shape with rounded corners at the edge that is distal from the wing 115.

All of the plurality of shield segments 110 are interconnected in a spooled manner to the pair of housings 102 using the first pivot 111 and the second pivot 112. The first pivot 111 attaches the first arm 116 of each of the plurality of shield segments 110 to the pair of housings 102 such that each of the plurality of shield segments 110 can freely rotate within or around the remaining each of the plurality of shield segments 110 contained with the shield 101. The second pivot 112 attaches the second arm 117 of each of the plurality of shield segments 110 to the pair of housings 102 such that each of the plurality of shield segments 110 can freely rotate within or around the remaining each of the plurality of shield segments 110 contained with the shield 101. The lock 113 is a locking mechanism that is attached to either the first pivot 111 or the second pivot 112 that is capable of locking into place the position of any of the plurality of shield segments 110 selected from the shield 101 relative to the remaining each of the plurality of shield segments 110 contained with the shield 101. Methods to lock the position of hinges and pivots are well known and documented within the mechanical arts.

The pair of housings 102 comprises a first grip 121, a second grip 122, a disinfecting chamber 123, and the cleaning fluid 124. The first grip 121 and the second grip 122 are attached to the disinfecting chamber 123. The first grip 121 and the second grip 122 attach to the toilet 131 rim 133. The cleaning fluid 124 is stored within the disinfecting chamber 123.

The disinfecting chamber 123 is a second U shaped block structure that is formed to follow the contour of the toilet 131 bowl 134 perimeter 135. Formed within the disinfecting chamber 123 is a cleaning channel 125. The cleaning channel 125 is a groove that is formed in the surface of the disinfecting chamber 123 that is proximal to the toilet 131 seat 132. The width 142 of the cleaning channel 125 is such that each of the each of the plurality of shield segments 110 will fit into the cleaning channel 125 when they are spooled. The each of the plurality of shield segments 110 are stored within the cleaning channel 125 when the first U shaped structure 114 is retracted 152. The cleaning fluid 124 is a liquid that is stored within the cleaning channel 125. When, during retraction 152, any of the plurality of sheilf segments 110 selected from the shield 101 is inserted into the cleaning channel 125, the plurality of sheild segments 110 is immersed in the cleaning fluid 124, which acts upon the plurality of sheild segments 110 to sanitize the respective one of the plurality of sheild segments 110. The cleaning fluid 124 is selected from the group consisting of redox agents or antimicrobials. Suitable redox agents include, but are not limited to, hypochlorite, hydrogen peroxide or halogens. Suitable antimicrobials include, but are not limited to, chlroxylenole, hexachlorophane, phenols, or quaternary ammonium.

As shown most clearly in FIG. 1, the first grip 121 and the second grip 122 attach the disinfecting chamber 123 to the toilet 131 rim 133. The first grip 121 is a clip that: 1) attaches to the disinfecting chamber 123; and, 2) fits around the toilet 131 rim 133 such that the disinfecting chamber 123 attaches securely to the toilet 131. The second grip 122 is a clip that: 1) attaches to the disinfecting chamber 123; and, 2) fits around the toilet 131 rim 133 such that the disinfecting chamber 123 attaches securely to the toilet 131.

The invention 100 is assembled by attaching the first arm 116 of each of the plurality of shield segments 110 to the disinfecting chamber 123 using the first pivot 111 such that: 1) each of the plurality of shield segments 110 is positioned within the cleaning channel 125; 2) each of the plurality of shield segments 110 is able to extend into and out of the cleaning channel 125. The second arm 117 of each of the plurality of shield segments 110 attaches to the disinfecting chamber 123 using the second pivot 112 such that: 1) each of the plurality of shield segments 110 is positioned within the cleaning channel 125; 2) each of the plurality of shield segments 110 is able to extend into and out of the cleaning channel 125.

Figure 5:
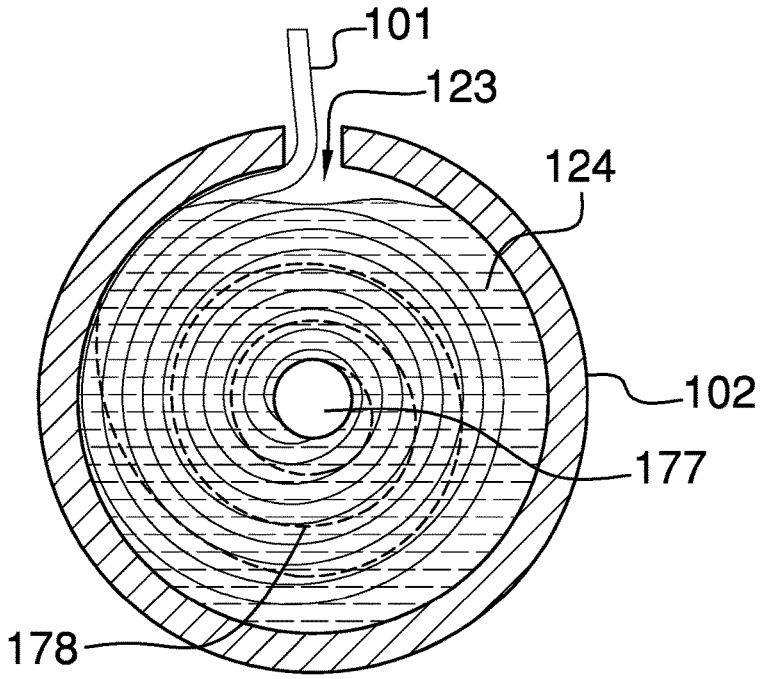
FIG. 5 is a cross-sectional view of an embodiment of the disclosure across 5-5 as shown in FIG. 3.
Figure 6:
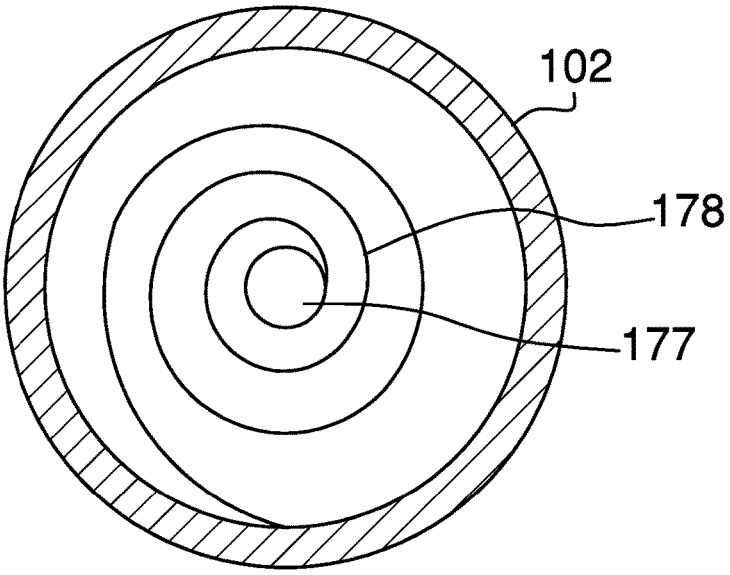
FIG. 6 is a cross-sectional view of an embodiment of the disclosure across 6-6 as shown in FIG. 3.

Referring to FIGS. 5 and 6, the second arm 117 of each of the plurality of shield segments 110 rotates about a spool 177 provided within the disinfecting chamber 123 of the respect one of the pair of housings 102. The same can be said for the first arm 116. The spool 177 is wound via a coiled spring 178 such that when the invention 100 is not in use, the applicable portions of the shield 101 are retracted into the disinfecting chamber 123. Moreover, the coiled spring 178 is located at a distal end of the spool 177 and the applicable pair of housings 101 so as not to interfere with the shield 101.

To use the invention 100, the toilet 131 seat 132 is lifted. The shield 101 is rotated such that the first U shaped structure 114 is formed. The toilet 131 is used normally after which the U shaped structure is returned to the retracted 152 position.

In the first potential embodiment of the disclosure, the invention 100 is formed from molded plastic. Suitable plastics include, but are not limited to polyvinylchloride. Polyvinylchloride is used in the first potential embodiment of the disclosure.

The following definitions were used in this disclosure:

Clip: As used in this disclosure, a clip is a fastener that attaches to an object by gripping or clasping the object.

Spooled: As used in this disclosure, spooled refers to a relationship between two or more objects contained within a collection wherein any first object selected from the collection either: 1) rolled within it a second object selected from the collection; 2) is rolled within a second object selected from the collection; or, 3) rolled within it a second object selected from the collection and is rolled within a third object selected from the collection.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object.

Trapezoid: As used in this disclosure, a trapezoid is a quadrilateral with one pair of parallel sides. An isosceles trapezoid is a trapezoid for which a line exists that: 1) intersects opposite sides of the trapezoid; and, 2) bisects the trapezoid into two congruent shapes or structures.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A barrier comprising:

a shield and a pair of housings;

wherein a portion of the shield is stored within one of the pair of housings;

wherein the shield extends beyond the pair of housings in order to form a first U shaped structure;

wherein the shield is extendable and retractable;

wherein the shield is adapted for use with a toilet;

wherein the toilet is further defined with a seat, a rim, a bowl, a perimeter, and an aperture;

wherein the shield attaches to the toilet between the toilet rim and the toilet seat;

wherein the shield extends the enclosed space formed by the toilet bowl by creating the first U shaped structure form in a manner that rises through the toilet aperture and above the toilet rim;

wherein the first U shaped structure contains the sprays and splashes of urination;

wherein portions of the shield retracts into the pair of housings;

wherein the pair of housings is attached to the toilet rim and mounted within the toilet bowl perimeter;

wherein the pair of housings contains a cleaning fluid that cleanses the first U shaped structure when portions of the shield are retracted.

2. The barrier according to claim 1 wherein the shield comprises a plurality of shield segments, a first pivot, a second pivot, and a lock;

wherein the first pivot, and the second pivot attach each of the plurality of shield segments to each other;

wherein the first pivot, the second pivot and the lock attach each of the each of the plurality of shield segments to the pair of housings;

wherein each of the plurality of shield segments selected from the shield is arranged to partially overlap an adjacent one of the plurality of shield segments such that collectively the plurality of shield segments form the first U shaped structure.

3. The barrier according to claim 2 wherein each of the plurality of shield segments selected from the shield is a rigid structure that comprises a wing, a first arm, and a second arm;

wherein the first arm and the second arm are attached to the wing such that the edge of the wing that the second arm is attached to is distal from the edge of the wing to which the first arm is attached.

4. The barrier according to claim 3 wherein the surfaces of the wing, the first arm, and the second arm are formed with a first curvature such that contour of each of the plurality of shield segments will follow the contour of the toilet bowl perimeter.

5. The barrier according to claim 4 wherein each of the plurality of shield segments selected from the shield is spooled within one of the pair of housings.

6. The barrier according to claim 5 wherein all of the plurality of shield segments are interconnected in a spooled manner to the pair of housings using the first pivot and the second pivot.

7. The barrier according to claim 6 wherein the first pivot attaches the first arm of each of the plurality of shield segments selected from the shield to the pair of housings such that each of the plurality of shield segments can freely rotate within or around the remaining each of the plurality of shield segments contained with the shield;

wherein the second pivot attaches the second arm of each of the plurality of shield segments selected from the shield to the pair of housings such that each of the plurality of shield segments can freely rotate within or around the remaining each of the plurality of shield segments contained with the shield.

8. The barrier according to claim 7 wherein the lock is a locking mechanism that is attached to a location selected from the group consisting of the first pivot or the second pivot;

wherein the lock locks place the position of any of the plurality of shield segments selected from the shield relative to the remaining each of the plurality of shield segments contained with the shield.

9. The barrier according to claim 8 wherein each of the pair of housings includes a disinfecting chamber;

wherein a first grip attaches one of the pair of housings to the toilet rim;

wherein a second grip attaches an opposing one of the pair of housings to the toilet rim.

10. The barrier according to claim 9 wherein a cleaning fluid is stored within the disinfecting chamber of each of the pair of housings.

11. The barrier according to claim 10 wherein the disinfecting chamber further comprises a cleaning channel;

wherein the cleaning channel is a groove that is formed in the surface of the disinfecting chamber that is proximal to the toilet seat.

12. The barrier according to claim 11 wherein the width of the cleaning channel is such that each of the each of the plurality of shield segments will fit into the cleaning channel when they are spooled therein;

wherein each of the each of the plurality of shield segments are stored within the cleaning channel when the first U shaped structure is retracted.

13. The barrier according to claim 12 wherein the first arm of each of the plurality of shield segments attaches to the disinfecting chamber using the first pivot;

wherein the second arm of each of the plurality of shield segments attaches to the disinfecting chamber using the second pivot;

wherein the first arm of each of the plurality of shield segments attaches to the disinfecting chamber such that each of the plurality of shield segments is positioned within the cleaning channel;

wherein the first arm of each of the plurality of shield segments attaches to the disinfecting chamber such that each of the plurality of shield segments is able to rotate into and out of the cleaning channel;

wherein the first arm of each of the plurality of shield segments attaches to the disinfecting chamber such that any of the plurality of shield segments selected from the shield is able to rotate around the first pivot;

wherein the second arm of each of the plurality of shield segments attaches to the disinfecting chamber such that each of the plurality of shield segments is positioned within the cleaning channel;

wherein the second arm of each of the plurality of shield segments attaches to the disinfecting chamber such that each of the plurality of shield segments is able to rotate into and out of the cleaning channel;

wherein the second arm of each of the plurality of shield segments attaches to the disinfecting chamber such that any of the plurality of shield segments selected from the shield is able to rotate around the second pivot.

14. The barrier according to claim 13 wherein the cleaning fluid is a liquid that is stored within the cleaning channel.

15. The barrier according to claim 14 wherein the cleaning fluid is selected from the group consisting of redox agents or antimicrobials.

16. The barrier according to claim 14 wherein the cleaning fluid is selected from the group consisting of hypochlorite, hydrogen peroxide or halogens.

17. The barrier according to claim 14 wherein the cleaning fluid is selected from the group consisting of chlroxylenole, hexachlorophane, phenols, or quaternary ammonium.

18. The barrier according to claim 14 wherein the plurality of shield segments rotates about a spool provided within the disinfecting chamber of the respect one of the pair of housings; wherein the spool is wound via a coiled spring such that when not in use, the applicable portions of the shield are retracted into the disinfecting chamber; wherein the coiled spring is located at a distal end of the spool and the applicable pair of housings so as not to interfere with the shield.

* * * * *